US006453283B1

(12) United States Patent
Gigi

(10) Patent No.: US 6,453,283 B1
(45) Date of Patent: Sep. 17, 2002

(54) SPEECH CODING BASED ON DETERMINING A NOISE CONTRIBUTION FROM A PHASE CHANGE

(75) Inventor: Ercan F Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/306,947

(22) Filed: May 7, 1999

(30) Foreign Application Priority Data

May 11, 1998 (EP) ..... 98201525

(51) Int. Cl.[7] ..... G10K 19/00

(52) U.S. Cl. ..... 704/207; 704/201

(58) Field of Search ..... 704/207, 205, 704/203, 226, 201; 375/244

(56) References Cited

U.S. PATENT DOCUMENTS

| | | | | | |
|---|---|---|---|---|---|
| 5,095,904 | A | * | 3/1992 | Seligman et al. | 128/420 |
| 5,809,459 | A | * | 9/1998 | Bergstrom et al. | 704/223 |
| 5,903,866 | A | * | 5/1999 | Shoham | 704/265 |
| 6,055,499 | A | * | 4/2000 | Chengalvarayan et al. | 704/250 |
| 6,067,511 | A | * | 5/2000 | Grabb et al. | 704/223 |
| 6,081,776 | A | * | 6/2000 | Grabb et al. | 704/219 |
| 6,119,082 | A | * | 9/2000 | Zinser Jr et al. | 704/223 |

FOREIGN PATENT DOCUMENTS

| | | | |
|---|---|---|---|
| EP | 0527529 A2 | 2/1993 | G10L/3/02 |
| WO | WO8809210 | 12/1988 | |

OTHER PUBLICATIONS

Hedelin et al, "Pitch Period Determination of Aperiodic Speech Signals", IEEE 1990, pp 361–364.*

Abe et al, "Robust Pitch Estimation . . . "pp 1277–1280, Spoekn Language 1996, ICSLP 96.*

Yegnanarayana et al, "An Iterative Algorithm for Decomposition of Speech Signals into Periodic and Aperiodic Components", IEEE Transactions on Speech and Audio Processing, pp. 1–11.*

McCree et al, "A Mixed Excitation LPC Vocoder Model for Low Bit Rate Speech Coding", 1995 IEEE, pp 242–250.*

"A mixed excitation LPC vocoder model for low bit rate speech coding", McCree & Barnwell, IEEE Transactions on speech and audio processing, vol. 3, No. 4, Jul. 1995.

* cited by examiner

*Primary Examiner*—Richemond Dorvil
*Assistant Examiner*—Michael N. Opsasnick
(74) *Attorney, Agent, or Firm*—Daniel J. Piotrowski

(57) ABSTRACT

An audio equivalent signal is coded by determining a noise value for harmonic frequencies. The noise value is determined by the change of phase of the harmonics in successive segments of the signal. The noise value for a harmonic frequency represents a contribution of a periodic component and an aperiodic component to the segment at the harmonic frequency. To this end, the pitch development of the signal is determined, and the signal is broken into segments of, e.g., one or two pitch periods wide. For each of the analysis segments an amplitude value and a phase value is determined for the harmonic frequencies. The noise value for each of the harmonics is determined by comparing the phase value for the harmonic of the segment to a corresponding phase value for at least one preceding or following segment. Each segment is coded as the amplitude value and the noise value for each of the harmonics. The method is preferably used for speech synthesis.

13 Claims, 6 Drawing Sheets

SPEECH CODING BASED ON DETERMINING A NOISE CONTRIBUTION FROM A PHASE CHANGE

BACKGROUND OF THE INVENTION

The invention relates to a method of coding an audio equivalent signal. The invention also relates to an apparatus for coding an audio equivalent signal. The invention further relates to a method of synthesising an audio equivalent signal from encoded signal fragments.

The invention also relates to a system for synthesising an audio equivalent signal from encoded audio equivalent input signal fragments. The invention further relates to a synthesiser.

The invention relates to a parametric production model for coding an audio equivalent signal. A widely used coding technique based on a parametric production model is the so-called Linear Predictive Coding, LPC, technique. This technique is particularly used for coding speech. The coded signal may, for instance, be transferred via a telecommunications network and decoded (resynthesised) at the receiving station or may be used in a speech synthesis system to synthesise speech output representing, for instance, textual input. According to the LPC model the spectral energy envelope of an audio equivalent signal is described in terms of an optimum all-pole filter and a gain factor that matches the filter output to the input level. For speech, a binary voicing decision determines whether a periodic impulse train or white noise excites the LPC synthesis filter. For running speech the, model parameters, i.e. voicing, pitch period, gain and filter coefficients are updated every frame, with a typical duration of 10 msec. This reduces the bit rate drastically. Although a classical LPC vocoder can produce intelligible speech, it often sounds rather buzzy. LPC is based on autocorrelation analysis and simply ignores the phase spectrum. The synthesis is minimum phase. A limitation of the classical LPC is the binary selection of either a periodic or a noise source. In natural speech both sources often act simultaneously. Not only in voiced fricatives but also in many other voiced sounds. An improved LPC coding technique is known from "A mixed excitation LPC vocoder model for low bit rate speech coding", McCree & Barnwell, IEEE Transactions on speech and audio processing, Vol. 3, No. 4, July 1995. According to this coding technique, a filter bank is used to split the input signal into a number of, for instance five, frequency bands. For each band, the relative pulse and noise power is determined by an estimate of the voicing power strength at that frequency in the input speech. The voicing strength in each frequency band is chosen as the largest of the correlation of the bandpass filtered input speech and the correlation of the envelope of the bandpass filtered speech. The LPC synthesis filter is excited by al frequency weighted sum of a pulse train and white noise.

In general the quality obtained by LPC is relatively low and therefore LPC is mainly used for communication purposes at low bitrates (e.g. 2400/4800 bps). Even the improved LPC coding is not suitable for systems, such as speech synthesis (text-to-speech), where a high quality output is desired. Using the LPC coding methods a great deal of naturalness is still lacking. This has hampered large scale application of synthetic speech in e.g. telephone services or automatic traffic information systems in a car environment.

SUMMARY OF THE INVENTION

It is an object of the invention to provide a parametric coding/synthesis method and system which enables the production of more natural speech.

To meet the object of the invention, the method of coding an audio equivalent signal comprises:

- determining successive pitch periods/frequencies in the signal;
- forming a sequence of mutually overlapping or adjacent analysis segments by positioning, a chain of time windows with respect to the signal and weighting the signal according to an associated window function of the respective time window;
- for each of the analysis segments:
  - determining an amplitude value and a phase value for a plurality of frequency Components of the analysis segment, including a plurality of harmonic frequencies of the pitch frequency corresponding to the analysis segment,
  - determining a noise value for each of the frequency components by comparing the phase value for the frequency component of the analysis segment to a corresponding phase value for at least one preceding or following analysis segment; the noise value for a frequency component representing a contribution of a periodic component and an aperiodic component to the analysis segment at the frequency; and
  - representing the analysis segment by the amplitude value and the noise value for each of the frequency components.

The inventor has found that an accurate estimate of the ratio between noise and the periodic component is achieved by pitch synchronously analysing the phase development of the signal, instead of (or in addition to) analysing the amplitude development. This improved detection of the noise contribution can be used to improve the prior art LPC encoding. Advantageously, the coding is used for speech synthesis systems.

In an embodiment according to the invention as described in the dependent claim 2, the, analysis window is very narrow. In this way, the relatively quick change of 'noisiness' which can occur in speech can be accurately detected.

In an embodiment according to the invention as decried in the dependent claim 3, the pitch development is accurately determined using a two step approach. After obtaining a rough estimate of the pitch, the signal is filtered to extract the frequency components near the detected pitch frequency. The actual pitch is detected in the pitch filtered signal.

In an embodiment according to the invention as described in the dependent claim 4, the filtering is based on convolution with a sine/cosine pair within a segment, which allows for an accurate determination of the pitch frequency component within the segment.

In an embodiment according to the invention as described in the dependent claim 5, interpolation is used for increasing the resolution for sampled signals.

In an embodiment according to the invention as described in the dependent claim 6, the amplitude and/or phase value of the frequency components are determined by a transformation to the frequency domain using the accurately determined pitch frequency as the fundamental frequency of the transformation. This allows for an accurate description of the periodic part of the signal.

In an embodiment according to the invention as described in the dependent claim 7, the noise value is derived from the difference of the phase value for the frequency component of the analysis segment and the corresponding phase value of at least one preceding or following analysis segment. This is a simple way of obtaining a measure for how much noise is present at that frequency in the signal. If the signal is highly dominated by the periodic signal, with a very low contribution of noise, the phase will substantially be the same.,On the other hand for a signal dominated by noise, the phase will 'randomly' change. As such the comparison of the phase provides an indication for the contribution of the periodic and aperiodic components to the input signal. It will be appreciated that the measure may also be based on phase information from more than two segments (e.g. the phase information from both neighbouring segments may be compared to the phase of the current segment).

In an embodiment according to the invention as described in the dependent claim 8, the noise value is based on a difference of a derivative of the phase value for the frequency component of the analysis segment and of the corresponding phase value of at least one preceding or following analysis segment. This provides a more robust measure.

To meet the object of the invention, the method of synthesising an audio equivalent signal from encoded audio equivalent input signal fragments, such as diphones, comprises:

retrieving selected ones of coded signal fragments, where the signal fragments have been coded according to the described coding method; and for each of the retrieved coded signal fragments creating a corresponding signal fragment by transforming the signal fragment to a time domain, where for each of the coded frequency components an aperiodic signal component is added in accordance with the respective noise value for the frequency component.

In this way a high quality synthesis signal can be achieved. So far, reasonable quality synthesis speech has been achieved by concatenating recorded actual speech fragments, such as diphones. With these techniques a high level of naturalness of the output can be achieved within a fragment. The speech fragments are selected and concatenated in a sequential order to produce the desired output. For instance, a text input (sentence) is transcribed to a sequence of diphones, followed by obtaining the speech fragments (diphones) corresponding to the transcription. Normally, the recorded speech fragments do not have the pitch frequency and/or duration corresponding to the desired prosody of the sentence to be spoken. The manipulation may be performed by breaking the basic speech signal into segments. The segments are formed by positioning a chain of windows along the signal. Successive windows are usually displaced over a duration similar to the local pitch period. In the system of EP-A 0527527 and EP-A 0527529, referred to as the PIOLA system, the local pitch period is automatically detected and the windows are displaced according to the detected pitch duration. In the so-called PSOLA system of EP-A 0363233 the windows are centred around manually determined locations, so-called voice marks. The voice marks correspond to periodic moments of strongest excitation of the vocal cords. The speech signal is weighted according to the window function of the respective windows to obtain the segments. An output sign al is produced by concatenating the signal segments. A lengthened output signal is obtained by repeating segments (e.g. repeating one in four segments to get a 25% longer signal). Similarly, a shortened output signal can be achieved by suppressing segments. The pitch of the output signal is raised, respectively, lowered by increasing or, respectively, lowering the overlap between the segments. Applied on running speech the quality of speech manipulated in this way can be very high, provided the range of the pitch changes is not too large. Complications arise, however, if the speech is built from relatively short speech fragments, such as diphones. The harmonic phase courses of the voiced speech parts may be quite different and it is difficult to generate smooth transitions at the borders between successive fragments, reducing the naturalness of the synthesised speech. In such systems the coding technique according to the invention can advantageously be applied. By not operating on the actual audio equivalent fragments with uncontrollable phase, instead fragments are created from the encoded fragments according to the invention. Any suitable technique may be used to decode the fragments followed by a segmental manipulation according to the PIOLA/PSOLA technique. Using a suitable decoding technique, the phase of the relevant frequency components can be fully controlled, so that uncontrolled phase transitions at fragment boundaries can be avoided. Preferably, sinusoidal synthesis is used for decoding the encoded fragments.

BRIEF DESCRIPTION OF THE DRAWINGS

These and other aspects of the invention will be apparent from and elucidated with reference to the embodiments shown in the drawings.

DETAILED DESCRIPTION OF THE DRAWINGS

Overall description

Figure 1:
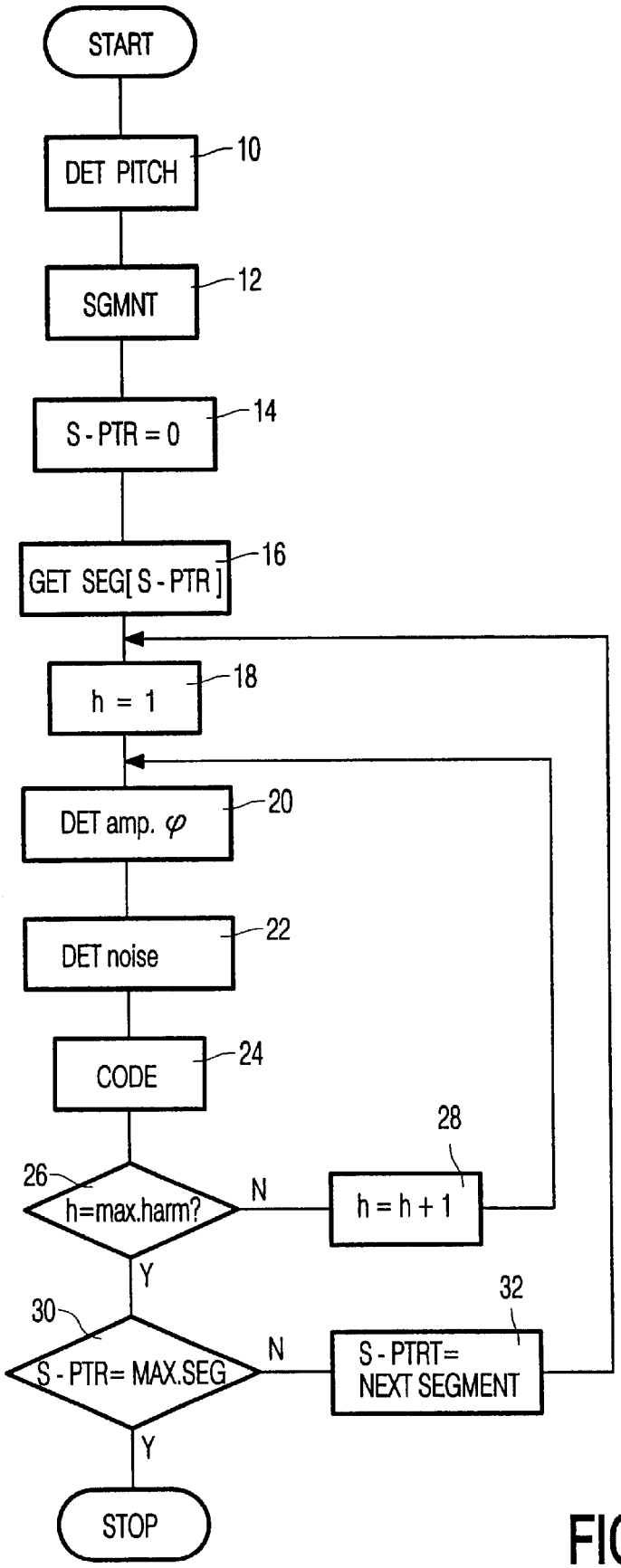
FIG. 1 shows the overall coding method according to the invention.

The overall coding method according to the invention is illustrated n FIG. 1. In step 10, the development of the pitch period (or as an equivalent: the pitch frequency) of an audio equivalent input signal is detected. The signal may, for instance represent a speech signal or a speech signal fragment such as used for diphone speech synthesis. Although the technique is targeted towards speech signals, the technique may also be applied to other audio equivalent signals, such as music. For such signals, the pitch frequency may be associated with the dominant periodic frequency component. The description focuses on speech signals.

In step 12, the signal is broken into a sequence of mutually overlapping or adjacent analysis segments. For forming the segments, a chain of time windows is positioned with respect to the input signal. Each time window is associated with a window function, as will be described in more detail below. By weighting the signal according to the window function of the respective windows, the segments are created.

In the following steps each of the analysis segments is analysed in a pitch synchronous manner to determine the phase values (and preferably at the same time also the amplitude values) of a plurality of harmonic frequencies within the segment. The harmonic frequencies include the pitch frequency, which is referred to as the first harmonic. The pitch frequency relevant for the segment has already been determined in step 10. The phase is determined with respect to a predetermined time instant in the segment (e.g. the start or the centre of the segment). To obtain the highest quality coding, as many as possible harmonics are analysed (within the bandwidth of the signal). However, if for instance a band-filtered signal is required only the harmonics within the desired frequency range need to be considered. Similarly, if a lower quality output signal is acceptable, some of the harmonics may be disregarded. Also for some of the harmonics only the amplitude may be determined where the noise value is determined for a subset of the harmonics. Particularly for the lower harmonics the signal tends to be mainly periodic, making it possible to use an estimated noise value for those harmonics. Moreover, the noise value changes more gradual than the amplitude. This makes it possible to determine the noise value for only a subset of the harmonics .(e.g. once for every two successive harmonics). For those harmonics for which no noise value has been determined, the noise value can be estimated (e.g. by interpolation). To obtain a high quality coding, the noise value is calculated for all harmonics within the desired frequency range. If representing all noise values would require too much storage or transmission capacity, the noise values can efficiently be compressed based on the relative slow change of the noise value. Any suitable compression technique may be used.

In step 14 the first segment is selected indicated by a segment pointer (s-ptr=0). The segment is retrieved (e.g. from main memory or a background memory) in step 16. In step 18 the first harmonic to be analysed is selected (h=1). In step 20, the phase (and preferably also the amplitude) of the harmonic is determined. In principle any suitable method for determining the phase may be used. Next in step 22, for the selected harmonic frequency a measure (noise value) is determined which indicates the contribution of a periodic signal component and an aperiodic signal component (noise) to the selected analysis segment at that frequency. The measure may be a ratio between the components or an other suitable measure (e.g. an absolute value of one or both of the components). The measure is determined by, for each of the involved frequencies, comparing the phase of the frequency in a segment with the phase of the same frequency in a following segment (or, alternatively, preceding segment). If the signal is highly dominated by the periodic signal, with a very low contribution of noise, the phase will substantially be the same. On the other hand for a signal-dominated by noise, the phase will 'randomly' change. As such the comparison of the phase provides an indication for the contribution of the periodic and aperiodic components to the input signal. It will be appreciated that the measure may also be based on phase information from more than two segments (e.g. the phase information from both neighbouring segments may be compared to the phase of the current segment). Also other information, such as the amplitude of the frequency component may be taken into consideration, as well as information of neighbouring harmonics.

In step 24, coding of the selected analysis segment occurs by, for each of the selected frequency component, storing the amplitude value and the noise value (also referred to as noise factor). It will be appreciated that since the noise value is derived from the phase value as an alternative to storing the noise value also the phase values may be stored.

In step 26 it is checked whether all desired harmonics have been encoded; if not the next harmonic to be encoded is selected in step 28. Once all harmonics have been encoded, in step 30 it is checked whether all analysis segments have been dealt with. If not, in step 32 the next segment is selected for encoding.

The encoded segments are used at a later stage. For instance, the encoded segments are transferred via a telecommunications network and decoded to reproduce the original input signal. Such a transfer may take place in 'real-time' during the encoding. The coded segments are preferably used in a speech synthesis (text-to-speech conversion) system.

For such an application, the encoded segments are stored, for instance, in a background storage, such as a harddisk or CD-ROM. For speech synthesis, typically a sentence is converted to a representation which indicates which speech fragments (e.g. diphones) should be concatenated and the sequence of the concatenation. The representation also indicates the desired prosody of the sentence. Compared with information, such as duration and pitch, available for the stored encoded segments, this indicates how the pitch and duration of the involved segments should be manipulated. The involved fragments are retrieved from the storage and decoded (i.e. converted to a speech signal, typically in a digital form). The pitch and/or duration is manipulated using a suitable technique (e.g. the PSOLA/PIOLA manipulation technique).

The coding according to the invention may be used in speech synthesis systems (text-to-speech conversion). In such systems decoding of the encoded fragments may be followed by further manipulation of the output signal fragment using a segmentation technique, such as PSOLA or PIOLA. These techniques use overlapping windows with a duration of substantially twice the local pitch period. If the coding is performed for later use in such applications, preferably already at this stage the same windows are used as are also used to manipulate the prosody of the speech during the speech synthesis. In this way, the signal segments resulting from the decoding can be kept and no additional segmentation need to take place for the prosody manipulation.

Segmenting

The sequence of analysis segments is formed by positioning a chain of mutually overlapping or adjacent time windows with respect to the signal. Each time window is associated with a respective window function. The signal is weighted according to the associated window function of a respective window of the chain of windows. In this way each window results in the creation of a corresponding segment. In principle, the window function may be a block form. This results in effectively cutting the input signal into non-overlapping neighbouring segments. For this, the window function used to form the segment may be a straightforward block wave:

$$W(t)=1, \text{ for } 0 \leqq t < L$$

$$W(t)=0, \text{ otherwise.}$$

Figure 2:
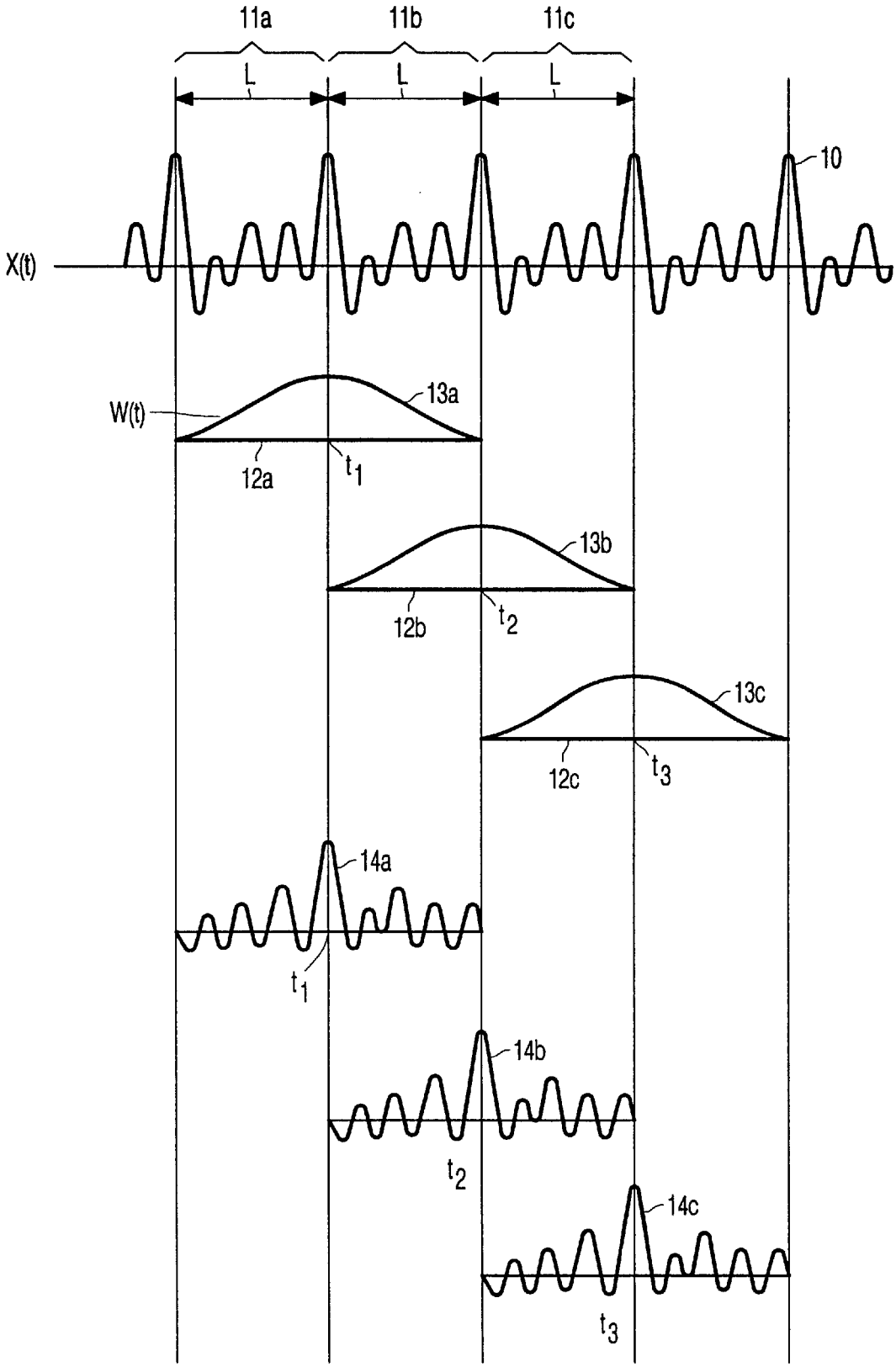
FIG. 2 shows segmenting a signal.

It is preferred to use windows which are wider than the displacement of the windows (i.e. the windows overlap). Preferably each window extends to the centre of the next window. In this way each point in time of the speech signal is covered by (typically) two windows. The window function varies as a function of the position in the window, where the function approaches zero near the edge of the window. Preferably, the window function is "self-complementary" in the sense that the sum of the two window functions covering the same time point in the signal is independent of the time point. An example of such windows is shown in FIG. 2. Advantageously, the window function is self complementary in the sense that the sum of the overlapping window functions is independent of time:

$$W(t)+W(t-L)=\text{constant, for } 0 \leqq t < L.$$

This condition is, for instance, met when $$W(t)=\tfrac{1}{2}-A(t)\cos[2\pi t/L+\Phi(V(t)]$$

where A(t) and >(t) are periodic functions of t, with a period of L. A typical window function is obtained when A(t)=½ and Φ(t)=0. Well-known examples of such self-complementary window functions are the Hamming or Hanning window. Using windows which are wider than the displacement results in obtaining overlapping segments.

Preferably, the windows are displaced over a local pitch period. In this way 'narrow' analysis segments are obtained (for a block-shape window, the width of the segment corresponds substantially to the local pitch period; for overlapping segments this may be twice the local pitch period). Since, the 'noisiness' can quickly change, using narrow analysis segments allows for an accurate detection of the noise values. It will be appreciated that if desired the windows may be displaced over a larger distance (in time), but this may reduce the quality of the coding.

In FIG. 2, the segmenting technique is illustrated for a periodic section of the audio equivalent signal 10. In this section, the signal repeats itself after successive periods 11*a*, 11*b*, 11*c* of duration L (the pitch period). For a speech signal, such a duration is on average approximately 5 msec. for a female voice and 10 msec. for a male voice. A chain of time windows 12*a*, 12*b*, 12*c* are positioned with respect to the signal 10. In FIG. 2 overlapping time windows are used, centred at time points "ti" (i=1,2,3.). The shown windows each extend over two periods "L", starting at the centre of the preceding window and ending at the centre of the succeeding window. As a consequence, each point in time is covered by two windows. Each time window 12*a*, 12*b*, 12*c* is associated with a respective window function W(t) 13*a*, 13*b*, 13*c*. A first chain of signal segments 14*a*, 14*b*, 14*c* is formed by weighting the signal 10 according to the window functions of the respective windows 12*a*, 12*b*, 12*c*. The weighting implies multiplying the audio equivalent signal 100 inside each, of the windows by the window function of the window. The segment signal Si(t) is obtained as $$Si(t)=W(t)\ X(t-ti)$$

Each of the segments obtained in this way are analysed and coded as described in more detail below after a description has been given for a preferred way of determining the pitch periods.

Determining the Pitch

The pitch synchronous analysis according to the invention requires an accurate estimate of the pitch of the input signal. In principle any suitable pitch detection technique may be used which provides a reasonable accurate estimate of the pitch value. It is preferred that a predetermined moment (such as the zero crossing) of the highest harmonic within the required frequency band can be detected with an accuracy of approximately 1/10th of a sample.

Figure 3:
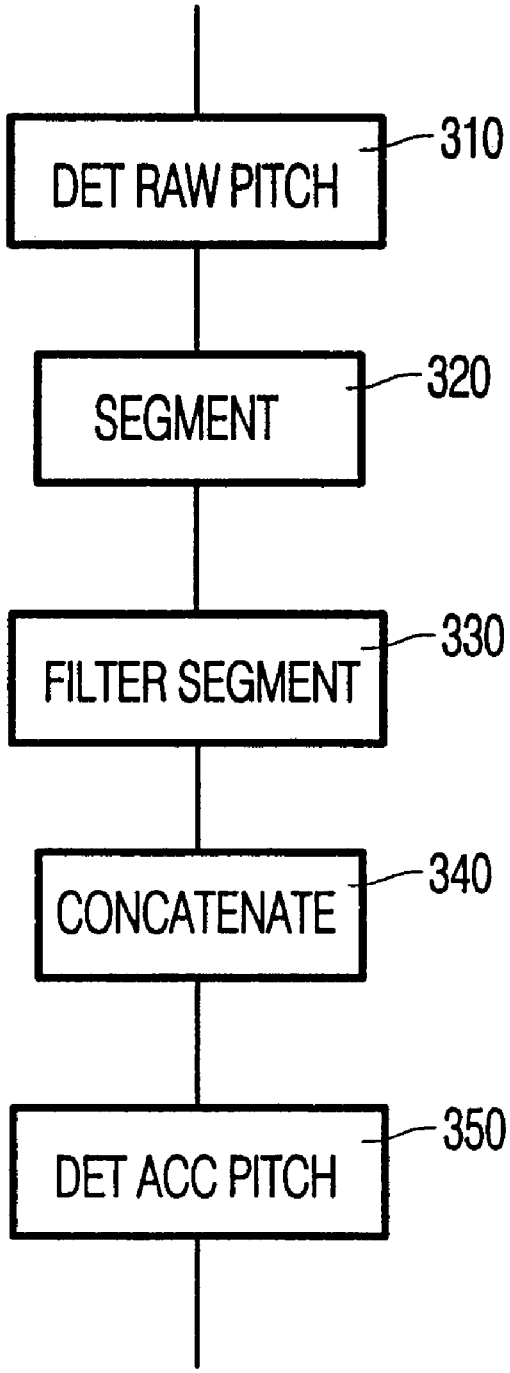
FIG. 3 shows accurately determining a pitch value using the first harmonic filtering technique according to the invention.
Figure 4A:
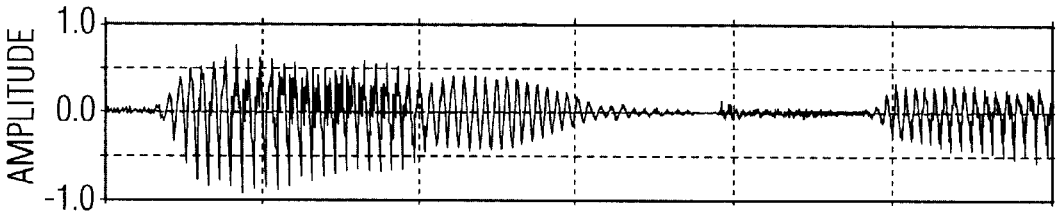
FIG. 4 shows the results of the first harmonic filtering.
Figure 4B:
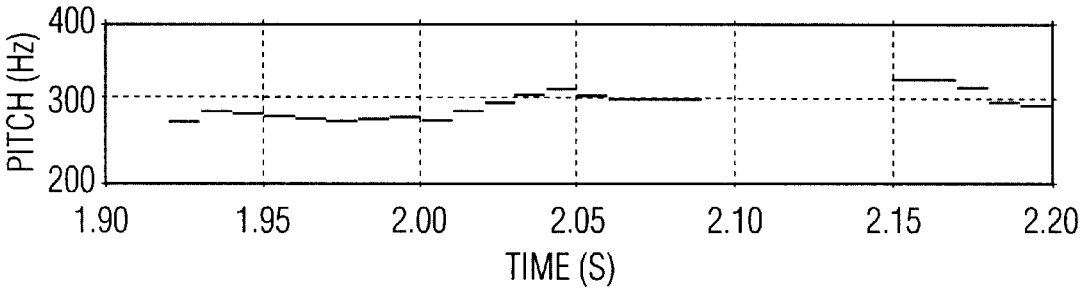
Figure 4C:
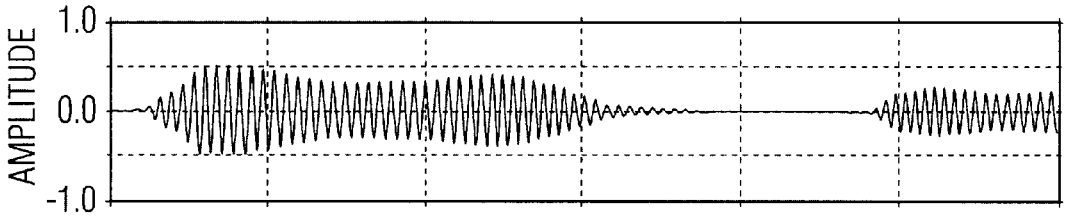
Figure 4D:
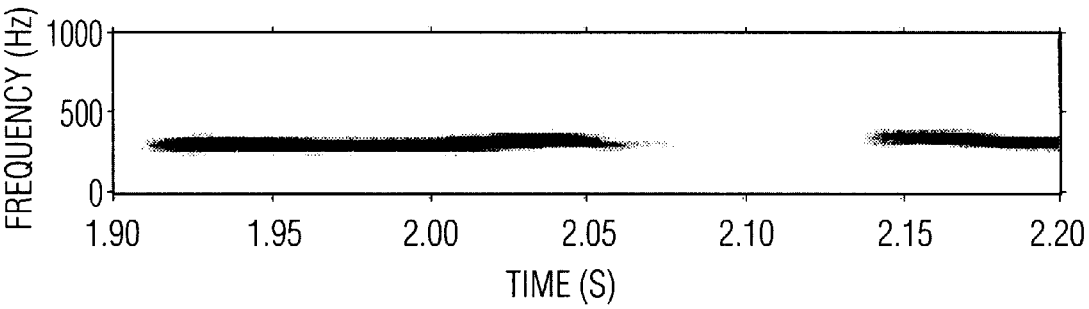

A preferred way of accurately determining the pitch, comprises the following steps as illustrated in FIG.3. In step 310, a raw value for the pitch is obtained. In principle any suitable technique may be used to obtain this raw value. Preferably, the same technique is also used to obtain a binary voicing decision, which indicates which parts of the speech signal are voiced (i.e. having an identifiable periodic signal) and which segments are unvoiced. Only the voiced segments need to be analysed further. The pitch may be indicated manually, e.g. by adding voice marks to the signals. Preferably, the local period length, that is, the pitch value, is determined automatically. Most known methods of automatic pitch detection are based on determining the distance between peaks in the spectrum of the signal, such as for instance described in "Measurement of pitch by subharmonic summation" of D. J. Hermes, Journal of the Acoustical Society of America, Vol. 83 (1988), no.1, pages 257–264. This technique may, for instance, be operated at a frame rate of 100 Hz. Other methods select a period which minimises the change in signal between successive periods. Most of these techniques are suitable for obtaining a raw indication of the pitch, as required for step 310, but are not sufficiently accurate to be directly used as the basis of the analysis in determining the noise value.

Therefore, based on the raw pitch value, a more accurate determination takes place. In step 320, the input signal is divided into a sequence of segments, referred to as the pitch detection segments. Similar as described above, this is achieved by positioning a chain of time windows with respect to the signal and weighting the signal with the window function of the respective time windows. Both overlapping or non-overlapping windows may be used. Preferably, an overlapping window, such as a Hamming or Hanning window, is used. The displacement and location of the time windows with respect to the signal is not highly critical. For instance, it is sufficient if the windows are displaced over the fixed time offset of e.g. 10 msec. If overlapping time windows are used, such a window may then extend over 20 msec. of the signal. If desired, the window may be displaced over the local pitch period of the signal.

In step 330, each of the pitch detection segments is filtered to extract the fundamental frequency component (also referred to as the first harmonic) of that segment. The filtering may, for instance, be performed by using a band-pass filter around the first harmonic. Preferably, the filtering is performed by convolution of the input signal with a sine/cosine pair. The modulation frequency of the sine/cosine pair is set to the raw pitch value. The convolution technique is well-known in the field of signal processing. In short, a sine and cosine are located with respect to the segment. For each sample in the segment, the value of the sample is multiplied by the value of the sine at the corresponding time. All obtained products (multiplication results) are subtracted from each other, giving the imaginary part of the pitch frequency component in the frequency domain. Similarly, for each sample in the segment, the value of the sample is multiplied by the value of the cosine at the corresponding time. All obtained products (multiplication results) are added together, giving the real part of the pitch frequency component in the frequency domain. The amplitude of the pitch frequency component is then given as the square root of the sum of the squares. of the real and imaginary parts. The phase is given as the arctan of the imaginary part divided by the real part (with corrections to bring the phase within the desired range and to deal with a real part equal to zero).

The following "C" code shows the convolution.

```
void CalculateAmplitudeAndPhase( double pitchFreq,
double sampleRate, double samples[ ],
long numSamples, double *ampl, double*phase)
{
double a=2.0*PI/ (sampleRate/pitchFreq);
double real=0.0; double imag=0.0;
unsigned i;
for (i=0; i<numSamples; i++){
  real+=samples[i]* cos(i*a);
  imag−=samples[i]* sin(i*a);
  }
  *ampl=sqrt(real*real+imag*imag);
*phase=real>0.0? atan(imag/real): real<0.0? atan(imag/
real)+PI:
  imag>=0.0?0.5* PI:1.5*PI;
}
```

In step 340, a concatenation occurs of the filtered pitch detection segments. If the segments have been filtered using the described convolution with the sine/cosine pair, first the filtered segment is created based on the determined phase and amplitudes This is done by generating a cosine (or sine) with a modulation frequency set to the raw pitch value and the determined phase and amplitude. The cosine is weighted with the respective window to obtain a windowed filtered pitch detection segment. The filtered pitch detection segments are concatenated by locating each segment at the original time instant and adding the; segments together (the segments may overlap). The concatenation results in obtained a filtered signal. In step 350, an accurate value for the pitch period/frequency is determined from the filtered signal. In principle, the pitch period can be determined as the time interval between maximum and/or minimum amplitudes of the filtered signal. Advantageously, the pitch period is determined based on successive zero crossings of the filtered signal, since it is easier to determine the zero crossings. Normally, the filtered signal is formed by digital samples, sampled at, for instance, 8 or 16 Khz. Preferably, the accuracy of determining the moments at which a desired amplitude (e.g. the maximum amplitude or the zero-crossing) occurs in the signal is increased by interpolation. Any conventional interpolation technique may be used (such as a parabolic interpolation for determining the moment of maximum amplitude or a linear interpolation for determining the moment of zero-crossing). In this way an accuracy well above the sampling rate can be achieved.

The results of the 'first-harmonic filtering' technique according to the invention are shown in FIG. 4. FIG. 4A shows a part of the input signal waveform of the word "(t)went(y)" spoken by a female. FIG. 4B shows the raw pitch value measured using a conventional technique. FIGS. 4C and 4D, respectively, show the waveform and spectogram after performing the first-harmonic filtering of the input signal of FIG. 4A.

It will be appreciated that the accurate way of determining the pitch as described above can also be used for other ways of coding an audio equivalent signal or other ways of manipulating such a signal. For instance, the pitch detection may be used in speech recognition systems, specifically for eastern languages, or in speech synthesis systems for allowing, a pitch synchronous manipulation (e.g. pitch adjustment or lengthening).

Determining the Noise Value for the Harmonics

Once an accurate pitch frequency has been determined, a phase value is determined for a plurality of harmonics of the fundamental frequency (pitch frequency) as derived from the accurately determined pitch period. Preferably, a transformation to the frequency domain, such as a Discrete Fourier Transform (DFT), is used to determine the phase of the harmonics, where the accurately determined pitch frequency is used as the fundamental frequency for the transform. This transform also yields amplitude values for the harmonics, which advantageously are used for the synthesis/decoding at a later stage. The phase values are used to estimate a noise value for each harmonic. If the input signal is periodic or almost periodic, each harmonic shows a phase difference between successive periods that is small or zero. If the input signal is aperiodic, the phase difference between successive periods for a given harmonic will be random. As such the phase difference is a measure for the presence of the periodic and aperiodic components in the input signal. It will be appreciated, that for a substantially aperiodic part of the signal, due to the random behaviour of the phase difference no absolute measure of the noise component is obtained for individual harmonics. For instance, if at a given harmonic frequency the signal is dominated by the aperiodic component, this may still lead to the phases for two successive periods being almost the. same. However, on average, considering several harmonics, a highly period signal will show little phase change, whereas a highly aperiodic signal will show a much higher phase change (on average a phase change of $\pi$). Preferably a 'factor of noisiness' in between 1 and 0 is determined for each harmonic by taking the absolute value of the phase differences and dividing them by $2\pi$. In voiced speech (highly period signal) this factor is small or 0, while for a less period signal, such as voiced fricatives, the factor of noisiness is significantly higher than 0. Preferably, the factor of noisiness is determined in dependence on a derivative, such as the first or second derivative, of the phase differences as a function of frequency. In this way more robust results are obtained. By taking the derivative components of the phase spectrum which are not affected by the noise are removed. The factor of noisiness may be scaled to improve the discrimination.

Figure 5A:
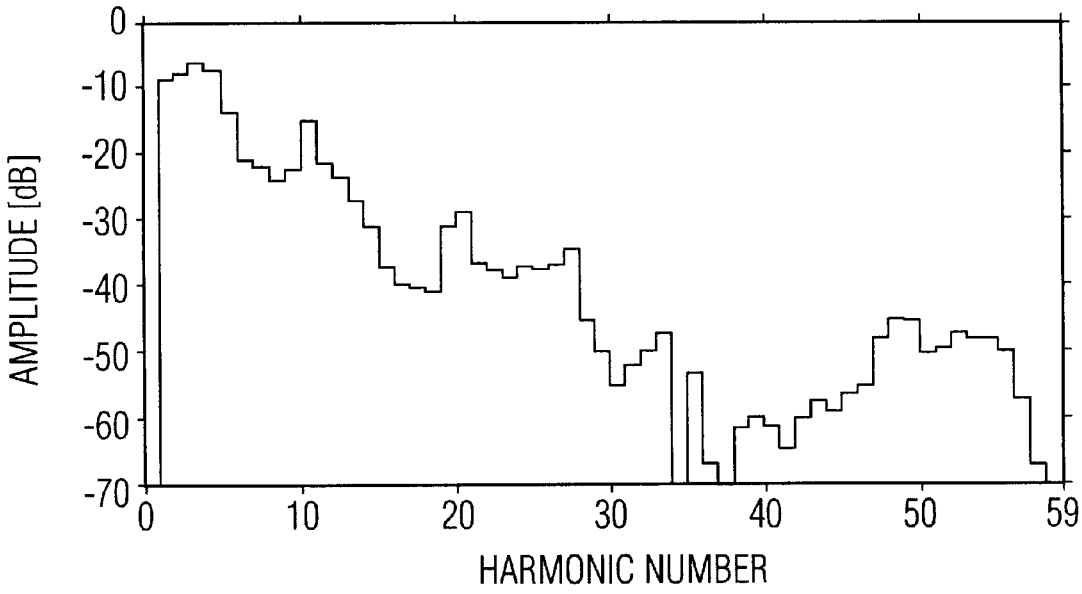
FIG. 5 shows the noise value using the analysis according to the invention.
Figure 5B:
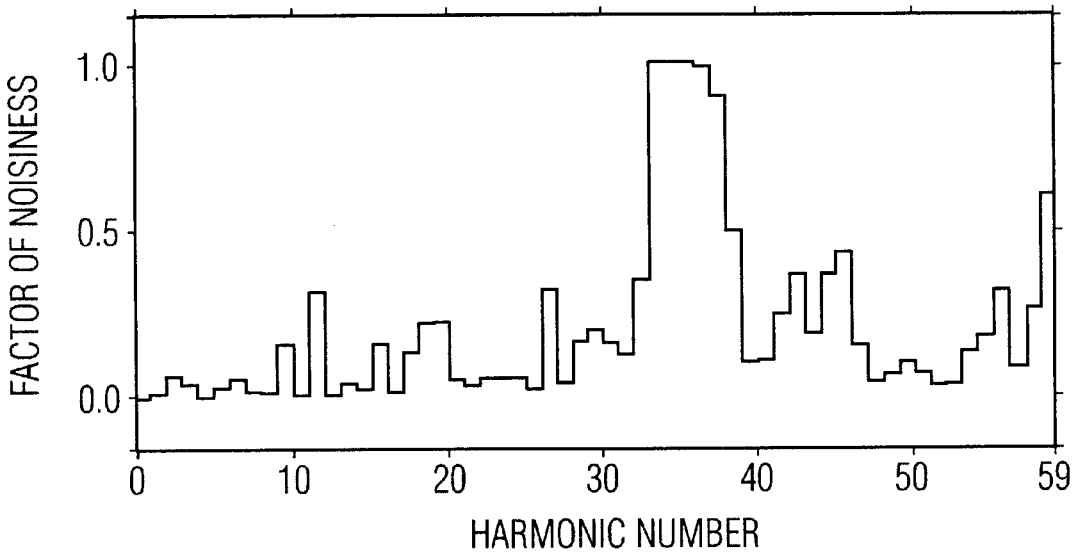

FIG. 5 shows an example of the 'factor of noisiness' (based on a second derivative) for all harmonics in a voiced frame. The voiced frame is a recording of the word "(kn)o (w)", spoken by a male, sampled at 16 Khz. FIG. 5A shows the spectrum representing the amplitude of the individual harmonics, determined via a DFT with a fundamental frequency of 135.41 Hz, determined by the accurate pitch frequency determination method according to the invention. A sampling rate of 16 Khz was used, resulting in 59 harmonics. It can be observed that some amplitude values are very low from the 35th to 38the harmonic. FIG. 5B shows the 'factor of noisiness' as found for each harmonic using the method according to the invention. It can now very clearly be observed that a relatively high 'noisiness' occurs in the region between the 32nd and 39th harmonic. As such the method according to the invention clearly distinguishes between noisy and less noisy components of the input signal. It is also clear, that the factor of noisiness can significantly vary in dependence on the frequency. If desired, the discrimination may be increased even further by also considering the amplitude of the harmonic, where a comparatively low amplitude of a harmonic indicates a high level of noisiness. For instance, if for a given harmonic the phase difference between two successive periods is low due to random behaviour of noise which is highly present at that frequency, the factor of noisiness is preferably corrected from being close to 0 to being, for instance, 0.5 (or even higher) if the amplitude is low, since the low amplitude indicates that at that frequency the contribution of the aperiodic component is comparable to or even higher than the contribution of the periodic component.

The above described analysis is preferably only performed for voiced parts of the signal (i.e. those parts with an identifiable periodic component). For unvoiced parts, the 'factor of noisiness' is set to 1 for all frequency components, being the value indicating maximum noise contribution. Depending on the type of synthesis used to synthesise an output signal, it may be required to obtain also information for the unvoiced parts of the input signal. Preferably, this is done using the same analysis method as described above for the voiced parts, where using an analysis window of, for instance, a fixed length of 5 msec., the signal is analysed using a DFT. For the synthesis of the unvoiced parts only the amplitude needs to be calculated; the phase information is not required since the noise value is fixed.

Synthesis

Preferably, a signal segment is created from the amplitude information obtained during the analysis for each harmonic.

This can be done by using suitable transformation from the frequency domain to the time domain, such as an inverse DFT transform. Preferably, the so-called sinusoidal synthesis is used. According to this technique, a sine with the given amplitude is generated for each harmonic and all sines are added together. It should be noted, that this normally is performed digitally by adding for each harmonic one sine with the frequency of the harmonics and the amplitude as determined for the harmonic. It is not required to generate parallel analogue signals and add those signals. The amplitude for each harmonic as obtained from the analysis represents the combined strength of the period component and the aperiodic component at that frequency. As such the re-synthesised signal also represents the strength of both components.

For the periodic component, in principle the phase can be freely chosen for each harmonic. According to the invention, for a given harmonic the initial phase for successive signal segments is chosen such that if the segments are concatenated (if required in an overlapping manner, as described in more detail below), no uncontrolled phase-jumps occur in the output signal. For instance, a segment has a duration corresponding to a multiple (e.g. twice) of the pitch period and the phase of a given harmonic at the start of the segments (and, since the segments last an integer multiple of the harmonic period, also at the end of the segments) are chosen to be the same. By avoiding a phase jump in concatenation of successive segments the naturalness of the output signal is increased.

It is not required that within one segment all harmonics start with the same phase. In fact, it is preferred that the initial phases of the various harmonics are reasonably distributed between 0 and $2\pi$. For instance, the initial value may be set at (a fairly arbitrary) value of:

$$2\pi(k-0.5)/k,$$

where k is the harmonic number and time zero is taken at the middle of the window. This distribution of non-zero values over the spectrum spreads the energy of the synthesised signal in time and prevents high peaks in the synthesised waveform.

The aperiodic component is represented by using a random part in the initial phase of the harmonics which is added to the described initial value. For each of the harmonics, the amount of randomness is determined by the 'factor of noisiness' for the harmonic as determined in the analysis. If no noticeable aperiodic component is observed, no noise is added (i.e. no random part is used), whereas if the aperiodic component is dominant the initial phase of the harmonic is significantly subjected to a random change (for a fully aperiodic signal up to the maximum phase variation between $-\pi$ and $\pi$). If the random noise factor is defined as given above where 0 indicates no noise and 1 indicates a 'fully aperiodic' input signal, the random part can be obtained by multiplying the random noise factor by a random number between $-\pi$ and $+\pi$. Generation of non-repetitive noise signals yields a significant improvement of the perceived naturalness of the generated speech. Tests, wherein a running speech input signal is analysed and re-synthesised according to the invention, show that hardly an y difference can be heard between the original input signal and the output signal. In these tests no pitch or duration manipulation of the signal took place.

Manipulation of duration or pitch

In FIG. 2 analysis segments $S_i(t)$ were obtained by weighting the signal 10 with the respective window function W(t). The analysis segments were stored in a coded form. For the synthesis, the analysis segments are recreated as described above. By straightforward superposing the decoded segments a signal similar to the original input signal is recreated with a controlled phase behaviour. Preferably, the segments are kept allowing for manipulation of the duration or pitch of a sequence of decoded speech fragments via the following overlap and add technique.

Figure 6A:
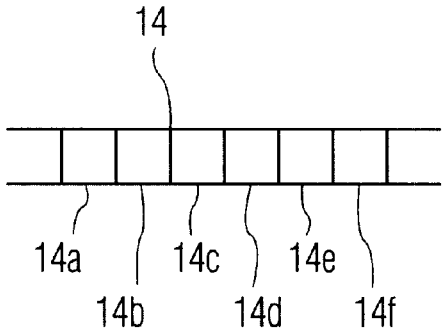
FIG. 6 illustrates lengthening a synthesised signal.
Figure 6B:
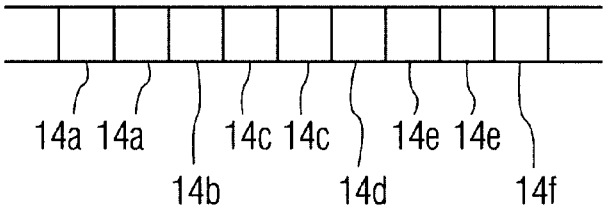
Figure 6C:
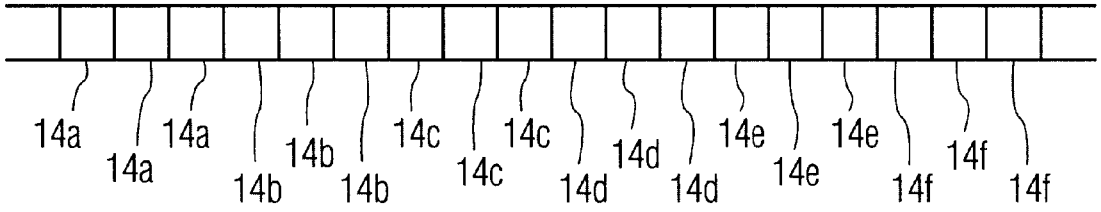

FIG. 6 illustrates forming a lengthened audio signal by systematically maintaining or repeating respective signal segments. The signal segments are preferably the same segments as obtained in step 10 of FIG. 1 (after encoding and decoding). In FIG. 6A a first sequence 14 of signal segments 14*a* to 14*f* is shown. FIG. 6B shows a signal which is 1.5 times as long in duration. This is achieved by maintaining all segments of the first sequence 14 and systematically repeating each second segment of the chain (e.g. repeating every "odd" or every "even" segment). The signal of FIG. 6C is lengthened by a factor of 3 by repeating each segment of the sequence 14 three times. It will be appreciated that the signal may be shortened by using the reverse technique (i.e. systematically suppressing/skipping segments).

The lengthening technique can also be used for lengthening parts of the audio equivalent input signal with no identifiable periodic component. For a speech signal, an example of such a part is an unvoiced stretch, that is a stretch containing fricatives like the sound "ssss", in which the vocal cords are not excited. For music, an example of a non-periodic part is a "noise" part. To lengthen the duration of substantially non-periodic parts, in a way similar as for the periodic parts, windows are placed incrementally with respect to the signal. The windows may still be placed at manually determined positions. Alternatively successive windows are displaced over a time distance which is derived from the pitch period of periodic parts, surrounding the non-period part. For instance, the displacement may be chosen to be the same as used for the last periodic segment (i.e. the displacement corresponds to the period of the last segment). The displacement may also be determined by interpolating the displacements of the last preceding periodic segment and the first following periodic segment. Also a fixed displacement may be chosen, which for speech preferably is sex-specific, e.g. using a 10 msec. displacement for a male voice and a 5 msec. displacement for a female voice.

For lengthening the signal, in principle non-overlapping segments can be used, created by positioning the windows in a non-overlapping manner, simply adjacent to each other. If the same technique is also used for changing the pitch of the signal it is preferred to use overlapping windows, for instance like the ones shown in FIG. 2. Advantageously, the window function is self complementary. The self complementary property of the window function ensures that by superposing the segments in the same time relation as they are derived, the original signal is retrieved. The decoded segments Si(t) are superposed to obtain an output signal Y(t). A pitch change of locally periodic signals (like for example voiced speech or music) can be obtained by placing the segments at new positions Ti, differing from the original positions ti (i=1,2,3.) before superpositioning the segments. To form, for example, an output signal with increased pitch, the segments are superposed With a compressed mutual centre to centre distance as compared to the distance of the segments as derived from the original signal. The length of the segments are kept the same. Finally, the segment signals are summed to obtain the superposed output signal Y:

$$Y(t)=\Sigma i\ Si(t-Ti)$$

(In the example of FIG.2 with the windows being two periods wide, the sum is limited to indices i for which $-L<t-Ti<L$). By nature of its construction this output signal Y(t) will be periodic if the input signal 10 is periodic, but the period of the output differs from the input period by a factor $$(ti-ti-1)/(Ti-Ti-1)$$

that is, as much as the mutual compression/expansion of distances between the segments as they are placed for the superpositioning. If the segment distance is not changed, the output signal Y(t) reproduces the input audio equivalent signal X(t). Changing the time position of the segments results in an output signal which differs from the input signal in that it has a different local period, but the envelope of its spectrum remains approximately the same. Perception experiments have shown that this yields a very good perceived speech quality even if the: pitch is changed by more than an octave.

It will be appreciated that a side effect of raising the pitch is that the signal gets shorter. This may be compensated by lengthening the signal as described above.

The duration/pitch manipulation method transforms periodic signals into new periodic signals with a different period but approximately the same spectral envelope. The method may be applied equally well to signals which have a locally determined period, like for example voiced speech signals or musical signals. For these signals, the period length L varies in time, i.e. the i-th period has a period-specific length Li. In this case, the length of the windows must be varied in time as the period length varies, and the window functions W(t) must be stretched in time by a factor Li, corresponding to the local period, to cover such windows:

$$Si(t)=W(t/Li)\ X(t-ti)$$

For self-complementary, overlapping windows, it is desired to preserve the self-complementarity of the window functions. This can be achieved by using a window function with separately stretched left and right parts (for $t<0$ and $t>0$ respectively)

$$Si(t)=W(t/Li)\ X(t+ti)\ (-Li<t<0)$$

$$Si(t)=W(t/Li+1)X(t+ti)\ (0<t<Li+1)$$

each part being stretched with its own factor (Li and Li+1 respectively). These factors are identical to the corresponding factors of the respective left and right overlapping windows.

Experiments have shown that locally periodic input audio equivalent signal fragments manipulated in the way described above lead to output signals which to the human ear have the same quality as the input audio equivalent signal, but with a different pitch and/or duration. By now applying the coding method of the invention, it can be ensured that no phase jumps occur for the harmonic frequencies at the places where a transition occurs between speech fragment. In this way, particularly for speech synthesis based on concatenation of relatively short speech fragments, the quality is improved. Tests have shown that the improvement in speech-synthesis due to using segments with a controlled phase for the harmonics are even more noticeable when segments are repeated in order to lengthen the signal. Repetition of segments, even if the segments in itself are highly aperiodic, results in a signal which is observed as containing a periodic elements. By for the aperiodic segments ensuring that the phase of successive segments changes substantially randomly, repetition is avoided.

FIG. 2 shows windows 12 which are positioned centred at points in time where the vocal cords are excited. Around such points, particularly at the sharply defined point of closure, there tends to be a larger signal amplitude (especially at higher frequencies). For signals with their intensity concentrated in a short interval of the period, centring the windows around such intervals will lead to most faithful reproduction of the signal. It is known from EP-A 0527527 and EP-A 0527529 that, in most cases, for good perceived quality in speech reproduction it is not necessary to centre the windows around points corresponding to moments of excitation of the vocal cords or for that matter at any detectable event in the speech signal. Rather, good results can be achieved by using a proper window length and regular spacing. Even if the window is arbitrarily positioned with respect to the moment of vocal cord excitation, and even if positions of successive windows are slowly varied good quality audible signals are achieved. For such a technique, the windows are placed incrementally, at local period lengths apart, without an absolute phase reference.

A full implementation of the coding and synthesis method has been realised and compared with several other vocoder implementations, among which the classical LPC vocoder. For manipulation of pitch and duration the new synthesis technique has shown to be superior. The test system allowed manipulation of the original pitch and duration contours. Speech synthesised with these new pitch courses according to the new method sounds much better than after the conventional PSOLA manipulation acting directly on originally recorded speech fragments. Also a substantial lengthening of unvoiced speech parts yields much better results when applying the new method. During these tests, each repeated segment is synthesised with noise from new random numbers, avoiding the artefact of introducing periodicity in noise signals.

The described methods for coding and synthesis can be implemented in suitable apparatuses and systems. Such apparatuses may be build using conventional computer technology and programmed to perform the steps according to the invention. Typically, an encoder according to the invention comprises an A/D converter for converting an analogue audio input signal to a digital signal. The digital signal may be stored in main memory or in a background memory. A processor, such as a DSP, can be programmed to perform the encoding. As such the programmed processor performs the task of determining successive pitch periods/frequencies in the signal. The processor also forms a sequence of mutually overlapping or adjacent analysis segments by positioning a chain of time windows with respect to the signal and weighting the signal according to an associated window function of the respective time window. The processor can also be programmed to determine an amplitude value and a phase value for a plurality of frequency components of each of the analysis segments, the frequency components including a plurality of harmonic frequencies of the pitch frequency corresponding to the analysis segment. The processor of the encoder also determines a noise value for each of the frequency components by comparing the phase value for the frequency component of an analysis segment to a corresponding phase value for at least one preceding or following analysis segment; the noise value for a frequency component representing a contribution of a periodic component and an aperiodic component to the analysis segment at the frequency. Finally, the processor represents the audio equivalent signal by the amplitude value and the noise value for each of the frequency components for each of the analysis segments. The processor may store the encoded signal in a storage medium of the encoder (e.g. harddisk, CD-ROM, or floppy disk), or transfer the encoded signal to another apparatus using communication means, such as a modem, of the encoder. The encoded signal may be retrieved or received by a decoder, which (typically under control of a processor) decodes the signal. The decoder creates for each of the selected coded signal fragments a corresponding signal fragment by transforming the coded signal fragment to a time do main, where for each of the coded frequency components an aperiodic signal component is added in accordance with the respective noise value for the frequency component. For reproducing the signal the decoder may also comprise a D/A converter and an amplifier, The decoder may be part of a synthesiser, such as a speech synthesiser. The synthesiser selects encoded speech fragments, e.g. as required for the reproduction of a textually represented sentence, decodes the fragments and concatenates the fragments. Also the duration and prosody of the signal may be manipulated.

What is claimed is:

1. A method of coding an audio equivalent signal, the method comprising:

determining successive pitch periods or frequencies in the signal;

forming a sequence of mutually overlapping or adjacent analysis segments by positioning a chain of time windows with respect to the signal and weighting the signal according to an associated window function of the respective time window;

for each of the analysis segments:

determining an amplitude value and a phase value for a plurality of frequency components of the analysis segment, including a plurality of harmonic frequencies of the pitch frequency corresponding to the analysis segment, determining a noise value for each of the frequency components by comparing the phase value for the frequency component of the analysis segment to a corresponding phase value for at least one preceding or following analysis segment; the noise value for a frequency component representing a contribution of a periodic component and an aperiodic component to the analysis segment at the frequency; and.

representing the analysis segment by the amplitude value and the noise value for each of the frequency components.

2. The method of coding an audio equivalent signal as claimed in claim 1, wherein positioning the chain of window comprises displacing each successive time window with respect to an immediately preceding one of the time windows substantially over a local pitch period.

3. The method of coding an audio equivalent signal as claimed in claim 1, characterised in that the step of determining successive pitch periods or frequencies in the signal comprises:

forming a sequence of mutually overlapping or adjacent pitch detection segments by weighting the signal according to an associated window function of a respective time window of a chain of time windows positioned with respect to the signal;

forming a filtered signal by for each of the pitch go detection segments:

estimating an initial value of the pitch frequency or period of the pitch detection segment; and filtering the pitch detection segment to extract a frequency component with a frequency substantially corresponding to the initially determined pitch frequency; and determining the successive pitch periods or frequencies from the filtered signal.

4. The method of coding an audio equivalent signal as claimed in claim 3, wherein the step of forming the filtered signal comprises:

convoluting the pitch detection segment with a sinusoidal pair with a modulation frequency substantially corresponding to the initially estimated pitch frequency, giving an amplitude and phase value for a sine or cosine with the same modulation frequency;

forming a filtered pitch detection segment by generating a windowed sine or cosine with the determined amplitude and phase; and concatenating the sequence of filtered pitch detection segments.

5. The method of coding an audio equivalent signal as claimed in claim 3, wherein the filtered signal is represented as a time sequence of digital samples and that the step of determining the successive pitch periods or frequencies of the filtered signal comprises:

estimating successive instants in which the sequence of samples meets a predetermined condition, and determining each of the instants more accurately by interpolating a plurality of samples around the estimated instant.

6. The method of coding an audio equivalent signal as claimed in claim 1, wherein the step of determining the amplitude and/or-phase value comprises transforming the signal segment to a frequency domain using the pitch frequency as a fundamental frequency of the transformation.

7. The method of coding an audio equivalent signal as claimed in claim 1, wherein the step of determining a noise value comprises calculating a difference of the phase value for the frequency component of the analysis segment and the corresponding phase value of at least one preceding or following analysis segment.

8. The method of coding an audio equivalent signal as claimed in claim 1, wherein the step of determining a noise value comprises calculating a difference of a derivative of the phase value for the frequency component of the analysis segment and of the corresponding phase value of at least one preceding or following analysis segment.

9. An apparatus for coding an audio equivalent signal, the apparatus comprising:

means for determining successive pitch periods or frequencies in the signal;

means for forming a sequence of mutually overlapping or adjacent analysis segments by positioning a chain of time windows with respect to the signal and weighting the signal according to an associated window function of the respective time window;

means for determining an amplitude value and a phase value for a plurality of frequency components of each of the analysis segments, the frequency components including a plurality of harmonic frequencies of the pitch frequency corresponding to the analysis segment, means for determining a noise value for each of the frequency components by comparing the phase value for the frequency component of an analysis segment to a corresponding phase value for at least one preceding or following analysis segment; the noise value for a frequency component representing a contribution of a periodic component and an aperiodic component to the analysis segment at the frequency; and means for representing the audio equivalent signal by the amplitude value and the noise value for each of the frequency components for each of the analysis segments.

10. A method of synthesising an audio equivalent signal from encoded audio equivalent input signal fragments, the method comprising the steps of:

retrieving selected ones of coded signal fragments, where the signal fragments have been coded according to the method as claimed in claim 1; and for each of the retrieved coded signal fragments creating a corresponding signal fragment by transforming the signal fragment to a time domain, where for each of the coded frequency components an aperiodic signal component is added in accordance with the respective noise value for the frequency component.

11. The method of synthesising an audio equivalent signal as claimed in claim 10, wherein the transforming to the time domain comprises performing a sinusoidal synthesis.

12. A system for synthesising an audio equivalent signal from encoded audio equivalent input signal fragments, such as diphones; the system comprising:

a coding apparatus for coding an audio equivalent signal as claimed in claim 9; the apparatus further comprising means for storing the coded representation of the audio equivalent signal in a storage medium; and a synthesiser comprising:

means for retrieving selected coded signal fragments from the storage medium, where the signal fragments have been coded by the coding apparatus; and means for creating for each of the selected coded signal fragments a corresponding signal fragment by transforming the coded signal fragment to a time domain, where for each of the coded frequency components an aperiodic signal component is added in accordance with the respective noise value for the frequency component.

13. A synthesiser comprising:

a processor operable for (1) retrieving selected coded signal fragments from a storage medium, where the signal fragments have been coded by a coding apparatus and (2) creating for each of the selected coded signal fragments a corresponding signal fragment by transforming the coded signal fragment to a time domain, where for each of the coded frequency components an aperiodic signal component is added in accordance with the respective noise value for the frequency component.

* * * * *